US005498858A

United States Patent [19]

Jeong

[11] Patent Number: 5,498,858

[45] Date of Patent: Mar. 12, 1996

[54] METHOD FOR CONTROLLING A VENTILATION MOTOR OF A MICROWAVE OVEN

[75] Inventor: Suk D. Jeong, Seoul, Rep. of Korea

[73] Assignee: Goldstar Co., Ltd., Seoul, Rep. of Korea

[21] Appl. No.: 249,596

[22] Filed: May 26, 1994

[30] Foreign Application Priority Data

May 26, 1993 [KR] Rep. of Korea ..... 1993-9175

[51] Int. Cl.[6] ..... H05B 6/64

[52] U.S. Cl. ..... 219/757; 219/719; 219/702; 126/299 D; 126/21 A

[58] Field of Search ..... 219/757, 400, 219/702, 719; 126/21 A, 21 R, 299 D

[56] References Cited

U.S. PATENT DOCUMENTS 5,120,916 6/1992 Horinouchi et al. ..... 219/757
5,350,903 9/1994 Takei ..... 219/757

*Primary Examiner*—Philip H. Leung
*Attorney, Agent, or Firm*—Spencer & Frank

[57] ABSTRACT

This invention relates to a method for controlling a ventilation motor of a microwave oven which is provided to control the ventilation motor automatically according to a setting time by a user. The method comprises steps for searching for presence of the timer key input, checking the present condition of operation of the ventilation motor if there was the timer key input, memorizing the ventilation motor operation period of time into the ventilation period of time memory part if the ventilation motor was under operation, checking the present condition of operation of the ventilation motor if there was no timer key input, checking up memories of the ventilation period of time memory part on a setting of the ventilation motor operation period of time, if the ventilation motor was under operation, checking finish of decrease of the preset operation period of time data of the ventilation motor while decreasing the preset data in the ventilation period of time memory means in every second if the operation period of time of the ventilation motor has been set, turning off the ventilation motor on finish of decrease of data as the result of the checking, and ventilation controlling in which the ventilation motor is turned off irrespective of the preset operation period of time of the ventilation motor if the ventilation motor turn off key is pressed while the ventilation motor is in operation.

3 Claims, 3 Drawing Sheets

METHOD FOR CONTROLLING A VENTILATION MOTOR OF A MICROWAVE OVEN

FIELD OF THE INVENTION

This invention relates to a microwave oven having a hood, more particularly to a method for controlling a ventilation motor of a microwave oven which is provided to control the ventilation motor automatically according to a setting time by a user.

BACKGROUND OF THE INVENTION

Shown in FIG. 1 is a block diagram of a conventional microwave oven having a hood including a key pad 101 for applying signals such as ventilation turn on/off signals, kind of cooking key signals, cooking period of time key signal etc., as a user intent in cooking mode, a clock generation part 102 for generating clocks in a fixed interval, a microcomputer 100 for computing the key signals received from the key pad 101 and the clocks generated in the clock generation part 102, and controlling entire system operation of the microwave oven, a ventilation relay 103 for opening/closing a ventilation opening of the ventilation motor in response to the control signals of the microcomputer 100, and a relay 104 for carrying out cooking mode by operating a magnetron and a turn table motor(not shown) in response to the control signals of the microcomputer. The microcomputer 100 has a key signal conversion part **100*b* for converting the key signals of the key pad 101 into corresponding data, a counter part 100*a* for counting the clocks in a fixed interval generated in the clock generation part 102, a controlling part 100*c* for distinguishing data received from the key signal conversion part 100*b* such as kind of cooking data, cooking period of time data and ventilation turn on/off data, and storing the kind of cooking data and the ventilation turn on/off data into a memory part 100*d*, computing, after storing cooking period of time data into a timer memory part 100*e*, the stored cooking period of time data and the counted value(actual lapse of time) of the counter part 100*a* and generating control signals corresponding to the computed data, a ventilation relay operation part 100*f* for controlling operation of a ventilation relay 103 in response to the on/off control signal generated in the control part 100*c*, and a relay operation part 100*g* for controlling operation of a relay 104 in response to the cooking period of time control signal of the control part 100*c***.

If cooking period of time and kind of cooking keys are selected on the key pad 101, the key signal conversion part **100*b* in the microcomputer 100 converts the applied cooking period of time key signal and kind of cooking key signal into corresponding data and transmits the converted data to the control part 100*c***.

And, the counter part **100*a* in the microcomputer 100 counts the clocks generated in a fixed interval in the clock generation part 102 and transmits the counted clock to the control part 100*c***.

The control part **100*c* stores kind of cooking data received from the key signal conversion part 100*b* into the memory part 100*d*, and computes total required cooking period of time referring to the stored kind of cooking data to store the computed total required cooking period of time into the timer memory part 100*e***.

Once the total required period of time has been computed, the control part **100*c* releases reset of the counter part 100*a* to detect actual lapse of time according to the number of clocks of the clock generation part 102 and turns on the relay 104 through the relay operation part 100*g*** during the computed total required cooking period of time.

Upon turning-on of the relay 104, a magnetron in rear side is actuated heating food on a turn table in a heating chamber.

Thereafter, when the actual lapse of time counted in the counter part **100*a* matches with the total required cooking period of time stored in the timer memory part 100*e*, ie., when cooking has been completed, the control part 100*c* turns off the relay 104 through the relay operation part 100*g*** to finish cooking operation.

Meantime, when a user presses a ventilation turn on key on a key pad 101 to discharge gas and moist from a heating chamber produced during cooking using a microwave oven, a gas range or other cookers, a key signal conversion part **100*b* of a microcomputer 100 converts the applied signals into corresponding data and transmits the converted data to a control part 100*c***.

The control part **100*c* stores the ventilation turn-on data of the key signal conversion part 100*b* into the memory part 100*d* and turns-on the ventilation relay 103 through the ventilation relay operation part 100*f***.

Upon turning on of the ventilation relay 103, a ventilation motor(not shown) in rear side is actuated to discharge gas and moisture in the heating chamber to outside.

And when a ventilation turn off key on the key pad 101 is pressed at completion of discharging gas and moisture from the heating chamber, the control part **100*c* of the microcomputer 100, following aforementioned process, turns off the ventilation relay 103 through the ventilation relay operation part 100*f*** to stop the ventilation motor.

However, in the foregoing ventilation motor control system of a microwave oven having a conventional hood function, a user has to press ventilation turn on key to discharge gas and moist from a chamber through a ventilation motor, and, to finish discharge operation on completion of discharge, the user has to press ventilation turn off key again to stop operation of the ventilation motor.

Accordingly, the user has experienced inconvenience of waiting for a long time from turning on of the ventilation motor to the completion of discharge of exhaust gas to go outside, and, if the user should press the ventilation motor turn off key in advance to go outside, the ventilation operation could not be carried out any further.

SUMMARY OF THE INVENTION

The object or this invention Is to provide a method or controlling a ventilation motor of a microwave oven which is provided to turn off the ventilation motor automatically at a preset time set by a user without pressing a ventilation motor turn off key.

These and other objects and features of this invention can be achieved by providing a method for controlling a ventilation motor of a microwave oven having ventilation on/off keys for turning on/off the ventilation motor, a timer key for setting operation period of time of the ventilation motor, and ventilation period of time memory part for memorizing a preset operation period of time, including steps for setting a ventilation period of time to set operation period of time of the ventilation motor through a timer key, a first ventilation controlling to operate the ventilation motor for a preset operation period of time of the ventilation motor and turn off the ventilation motor on lapse of the operation period of time, and a second ventilation controlling to turn off the ventilation motor irrespective of the preset operation period of time of the ventilation motor on application of the ventilation motor turn off key while operation of the ventilation motor.

DETAILED DESCRIPTION OF THE INVENTION

Figure 1:
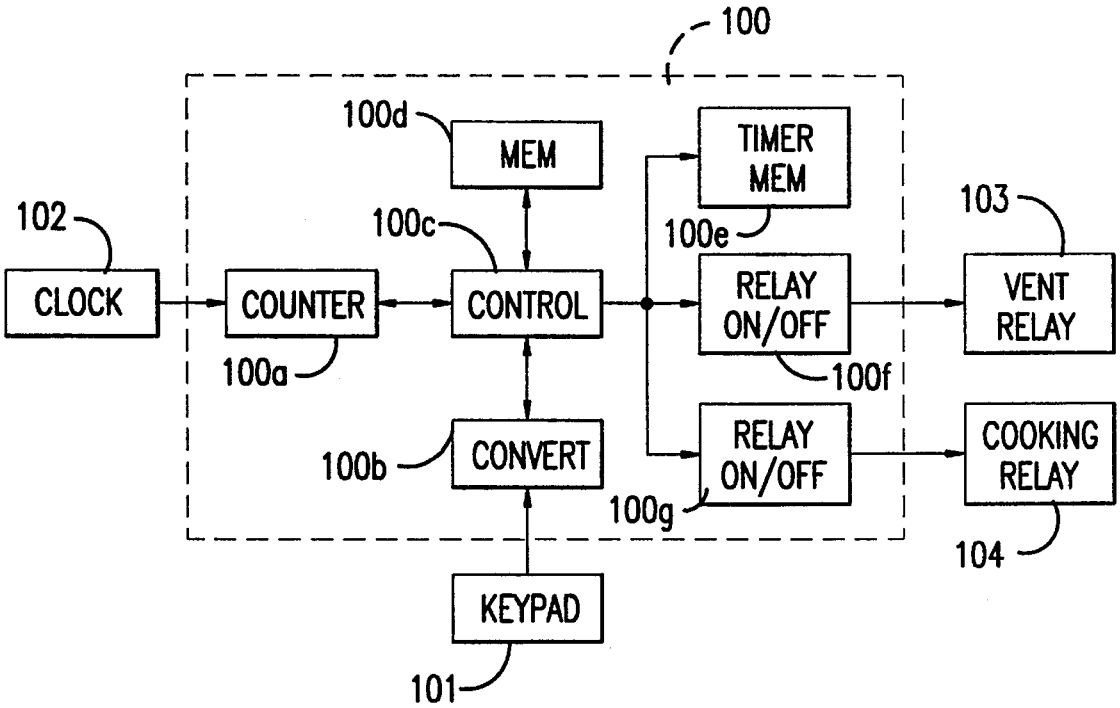
FIG.1 PRIOR ART
FIG. 1 is a block diagram of a microwave oven having a conventional hood function.
Figure 2:
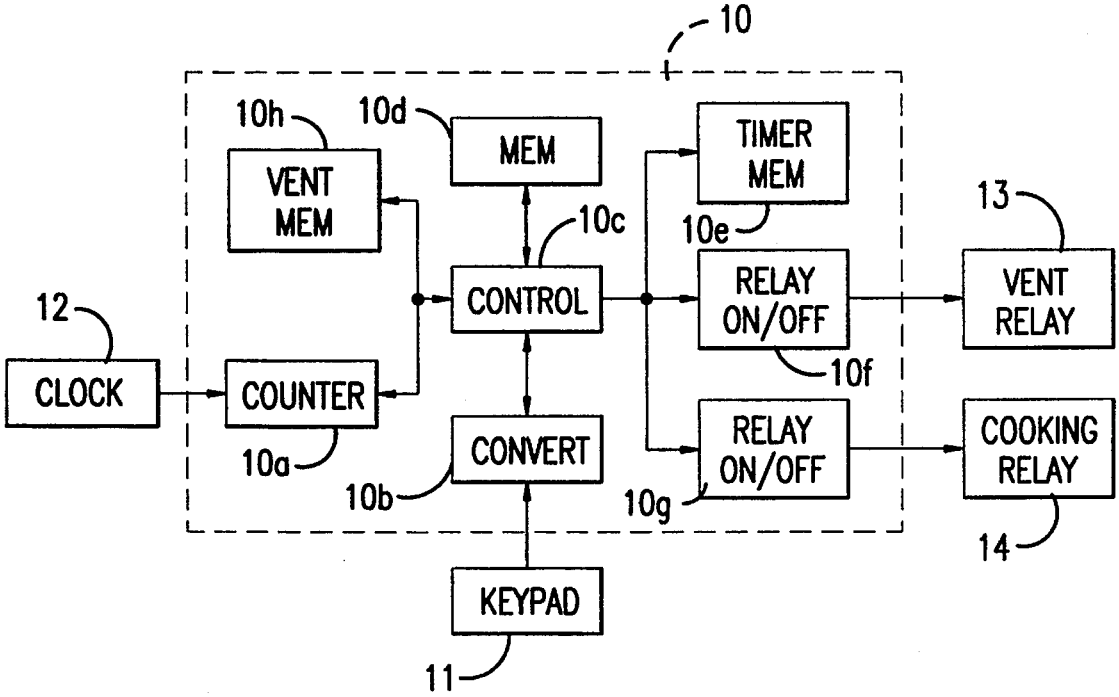
FIG. 2 is a block diagram of a microwave oven having a hood function in accordance with this invention.
Figure 3:
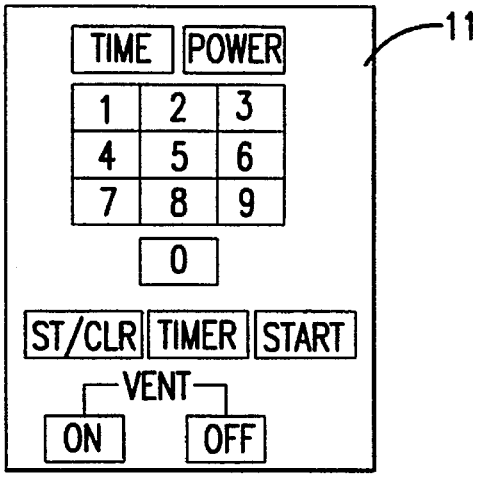
FIG. 3 shows the detail of the key pad of FIG. 2.

FIG. 2 is a block diagram of a microwave oven having a hood function in accordance with this invention and FIG. 3 shows the detail of the key pad of FIG. 2.

A microwave oven of this invention includes a key Dad 11 having ventilation on/off keys, kind of cooking keys, power key, timer key, cooking start key, stop/clear keys etc., for generating key signals according to selection of a user, a clock generation part 12 for generating clocks in a fixed interval, a microcomputer 10 for computing key signals generated in the key pad 11 such as cooking period of time key signal, kind of cooking key signal, ventilation on/off key signals and ventilation operation time key signal, and clocks generated in the clock generation part 12, to control entire system operation of the microwave oven, a ventilation relay 13 for performing switching operation in response to the ventilation on/off control signals generated in the microcomputer 10, a ventilation motor 15 for drawing-in and discharging gas and moisture from a heating chamber through a suction 17 and a discharge 18 openings formed on the body of the microwave oven operated in response to the switching operation of the ventilation relay 13, and a relay 14 for operating the magnetron and the turntable motor in response to the control signals for the total required cooking period fo time generated in the microcomputer 10 carrying out cooking operation.

The microcomputer 10 includes a key signal conversion part **10*b* for converting various key signals received from the key pad 11 into corresponding data, counter part 10*a* for counting clocks generated in fixed interval in the clock generation part 12, a control part 10*c* for distinguishing kind of cooking data, cooking period of time data, ventilation on/off data and ventilation operation period of time data, storing the kind of cooking data and the ventilation on/off data into the memory part 10*d*, the cooking period of time data into the timer memory part 10*e* and the ventilation operation period of time data into the ventilation period of time memory part 10*h*, respectively, computing the cooking period of time data and the ventilation motor turn on period of time data stored in the timer memory part 10*e* and the ventilation period of time memory part 10*h*, respectively and actual lapse of time counted in the counter part 10*a* and generating control signals corresponding to the computed period of time, a ventilation relay operation part 10*f* operated in response to the ventilation on/off control signal of the control part 10*c* for turning on/off the ventilation relay 13, and a relay operation part 10*g* for turning on/off the relay 14 in response to the cooking period of time control signal of the control part 10*c***.

Reference number 19 represents a supporting table of the microwave oven.

Figure 5:
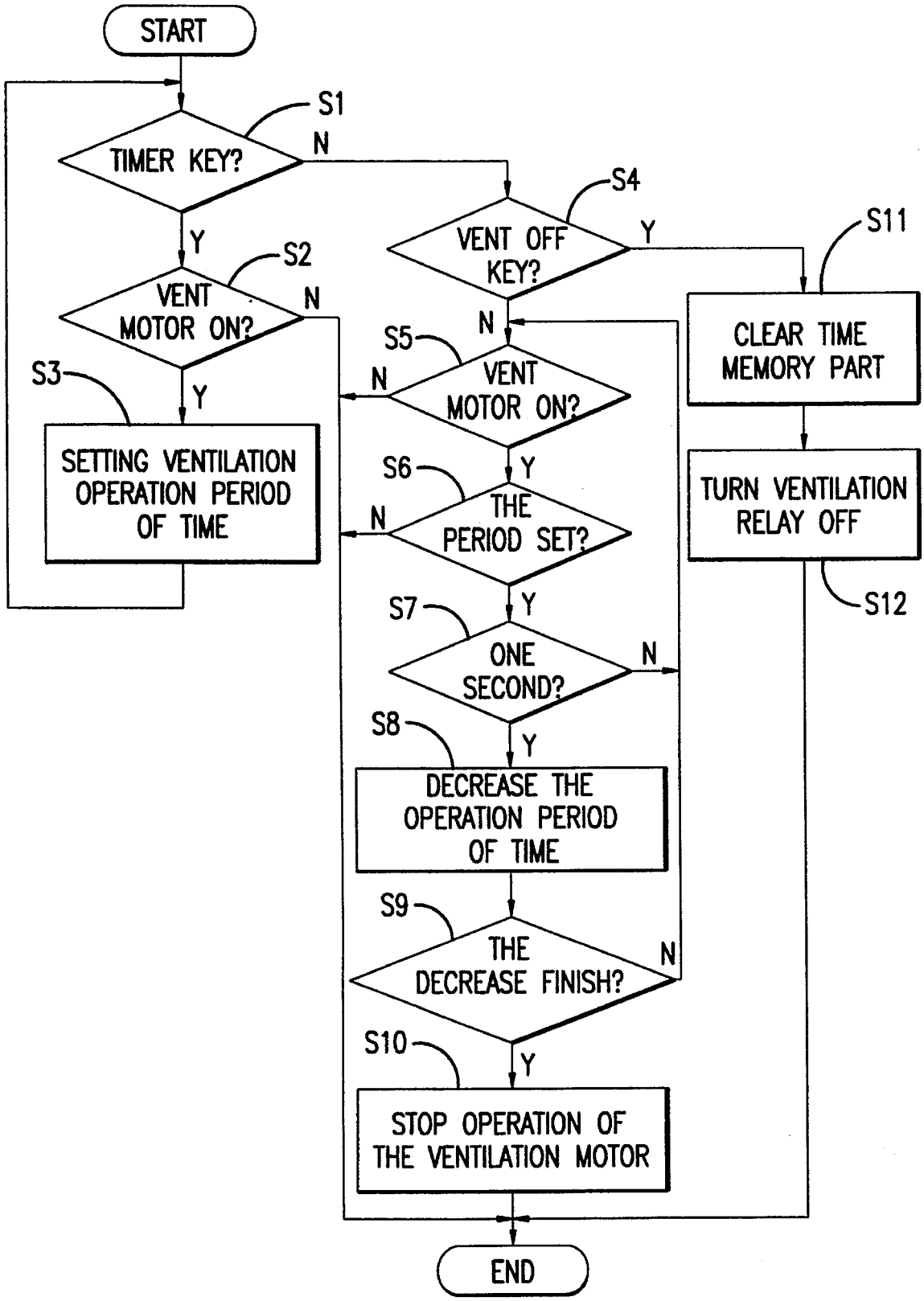
FIG. 5 is a flow chart showing the operation of FIG. 2.

FIG. 5 is a flow chart explaining operation of FIG. 2, whereby a method for controlling turning on/off operation of the ventilation motor 15 is to be explained, hereinafter.

When the ventilation turn on key on the key pad 11 was pressed for discharging gas and moisture generated during cooking using microwave oven, gas range on a supporting table 19, or other cookers to outside(step S1), the key signal conversion part **10*b* of the microcomputer 10 converts the ventilation turn on key signal into ventilation turn on data and applies the data to the control part 10*c***.

The control part 10 stores the ventilation turn on data into the memory part **10*d* and turns on the ventilation relay 13 through the ventilation relay operation part 10*f***.

Figure 4:
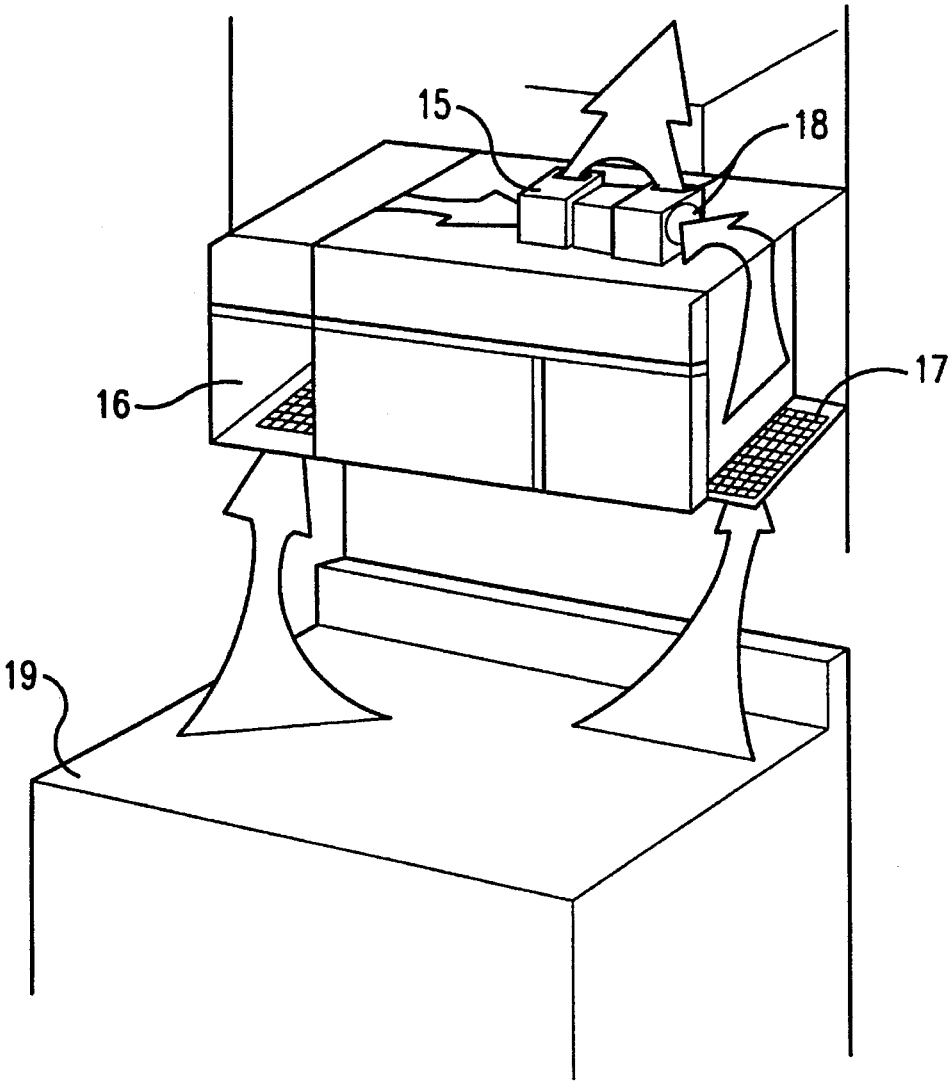
FIG. 4 shows a perspective view of a microwave oven having a hood function in accordance with this invention.

Upon turning on of the ventilation relay 13, the ventilation motor 15 is operated(step S2) to discharge gas and moisture from the heating chamber to outside through the suction opening 17 and the discharge opening 18 formed on the body of the microwave oven as shown in FIG. 4.

In the foregoing process of discharging gas and moist from the heating chamber using the ventilation motor 15, if a user sets ventilation operation period of time using the timer key on the key pad 11 (step S3), the control part **10*c* of the microcomputer 10 checks up the ventilation turn on data stored in the memory part 10*d* on whether the ventilation motor 19** is in operation at the present time.

If the ventilation motor was found was in operation at that time, the control part **10*c* of the microcomputer 10 stores the ventilation operation period of time set by a user using the key pad 11 into the ventilation period of time memory part 10*h* and releases the reset of the counter part 10*a* to decrease the operation period of time data stored in the ventilation period of time memory part 10*h* by one second on occurrence of overflow from the counter part 10*a*** in every one second (steps S4 to S8).

Thereafter, when finish of the decrease of the data has been confirmed through continuous check on the ventilation operation period of time data in the ventilation period of time memory part **10*h* (step S9), the ventilation relay 13 is turned off through the ventilation relay operation part 10*f* to stop operation of the ventilation motor 15** (step S10).

And, if the ventilation turn off key was pressed while operation of the ventilation motor 15, the ventilation period of time memory part **10*h* is cleared irrespective of the ventilation operation period of time data stored in the ventilation period of time memory part 10*h* and the ventilation relay 13 is turned off through the ventilation relay operation part 10*f* to stop operation of the ventilation motor 15** (steps S11 and S12).

The operation period of time input of the ventilation motor 15 can be possible before and while the operation of the ventilation motor 15.

As has been explained, this invention for a microwave oven having a hood function provides maximum convenience of use as well as perfect ventilation function by facilitating a ventilation motor which is under operation discharging gas and moisture generated during cooking within a chamber to be turned off automatically at a preset time set by a user without pressing a ventilation turn off key.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A method of controlling a ventilation motor of a microwave oven, said microwave oven has ventilation turn on/off keys for turning on/off the ventilation motor, timer key is for setting operation period of time of the ventilation motor and a ventilation period of time memory part for memorizing the set operation period of time, comprising steps of:

searching for presence of the timer key input;

checking the present condition of operation of the ventilation motor if there was the timer key input;

memorizing the ventilation motor operation period of time into the ventilation period of time part if the ventilation motor was under operation;

checking the present condition of operation of the ventilation motor if there was no timer input;

checking up memories of the ventilation period of time memory part on a setting of the ventilation motor operation period of time, if the ventilation motor was under operation;

checking that a decrease of the preset operation time data of ventilation motor is completed while decreasing the preset data in the ventilation period of time memory means in every second if the operation period of time of the ventilation motor has been set;

turning off the ventilation motor in case that the decrease of the preset operation time data of ventilation motor is completed from the checking result of said completion of decrease step; and ventilation controlling in which the ventilation motor is turned off irrespective of the preset operation period of time of the ventilation motor if the ventilation motor turn off key is pressed while the ventilation motor is in operation.

2. The method as claimed in claim 1, wherein the ventilation controlling step includes steps for:

searching the ventilation turn on/off keys on the presence of input of the ventilation off key while the ventilation motor is in operation; and clearing the ventilation period of time memory part and stopping operation of the ventilation motor if the turn off key was present.

3. A method of controlling a ventilation motor to drive a fan in a hood spaced above a microwave oven, said fan drawing air upwardly through said hood; said microwave oven including keys for turning the ventilation motor on or off, a timer key for setting a period of time for operating the ventilation motor, memory means for storing the set operation period of time for the motor, and clock and counter means for decreasing the stored period of time comprising steps of:

a) searching for a timer key input setting a period of time for operating the ventilation motor;

b) when there is a timer key input, checking the state of the ventilation motor to determine whether on or off;

c) if the motor is in an on state, storing the period of time found in step (a) in said memory means;

d) if there is no timer key input, checking the state of the ventilation motor to determine whether on or off;

e) if the motor is in an on state, checking the memory means for a stored set operation period of time for the motor;

f) if the memory means has a stored set operation period of time for the motor, checking for the end of the stored period of time while decreasing the stored period of time in the memory means in response to the clock and counter means;

g) at the end of the stored period of time, turning off the ventilation motor; and h) if the ventilation motor off key is operated while the ventilation motor is in an on state, turning the ventilation motor off irrespective of the stored period of time in the memory means.

* * * * *